US005718205A

United States Patent [19]

Jo

[11] Patent Number: 5,718,205

[45] Date of Patent: Feb. 17, 1998

[54] FUEL INJECTION SYSTEM WITH VARIABLE INJECTION POSITION

[75] Inventor: Kwang-Hyun Jo, Kyunggi-do, Rep. of Korea

[73] Assignee: Kia Motors Corporation, Seoul, Rep. of Korea

[21] Appl. No.: 673,185

[22] Filed: Jun. 27, 1996

[51] Int. Cl.[6] ..... F02M 37/04

[52] U.S. Cl. ..... 123/470; 123/337

[58] Field of Search ..... 123/470, 469, 123/468, 337, 472

[56] References Cited

U.S. PATENT DOCUMENTS

| | | | |
|---|---|---|---|
| 2,740,391 | 4/1956 | Bosch | 123/337 |
| 3,791,366 | 2/1974 | MacMillian | 123/337 |
| 4,295,452 | 10/1981 | Lembke | 123/469 |
| 4,317,440 | 3/1982 | Thatcher | 123/470 |
| 4,351,305 | 9/1982 | Isogai | 123/470 |
| 4,922,876 | 5/1990 | Mizoguchi | 123/470 |
| 5,029,564 | 7/1991 | Neutzer | 123/337 |
| 5,048,500 | 9/1991 | Corhan | 123/470 |

*Primary Examiner*—Carl S. Miller

[57] ABSTRACT

Disclosed is a fuel injection system with a variable injection position, including an accelerating pedal, a throttle valve for regulating the amount of intake air in response to vehicle speed, a fuel distribution pipe, an injector fixed to the fuel distribution pipe, an accelerating lever which rotates in response to pedal effort of the accelerating pedal, a pinion which rotates in accordance with the rotation of the accelerating lever, and a rack which slides horizontally in response to the rotation of the pinion to vary the position of the injector that is fixed on the fuel distribution pipe.

10 Claims, 1 Drawing Sheet

FUEL INJECTION SYSTEM WITH VARIABLE INJECTION POSITION

BACKGROUND

1. Field of Invention

The present invention relates to a fuel injection system with a variable injection position and, more particularly, to a fuel injection system which can improve responsiveness to the operation of an accelerating pedal by properly varying the position of an injector in response to a throttle valve opening.

2. Description of Related Art

Gasoline fuel injection systems have been used for many years. An advantage of gasoline fuel injection over carburetted systems is more precise control over fuel metering, the result of which is better performance, improved economy, and lower exhaust emissions.

Two types of fuel injection systems are currently in use and are classified into one of two types, a multi-point injection type or a single-point injection type. The present invention can be applied to both of these types.

An electronically controlled fuel injection system comprises a fuel system having a fuel feed pump, an injector, and a fuel pressure regulator; an intake system having an air sensor, throttle body, a surge tank, and an intake manifold; and an electronic system.

The injector is located on the intake manifold to inject fuel into a combustion chamber. Electronic systems use a number of engine sensors to feed information to the electronic control unit or computer. The electronic control unit (ECU) processes the information based on stored information already in the computer, and then regulates how much fuel the fuel injector should inject.

In other words, the ECU receives an output voltage of a throttle position sensor, which detects the position of a throttle valve that varies its position in response to the pedal effort of an accelerating pedal and to other input signals such as engine RPM, as well as detects the status of the engine and thereby regulates the amount of fuel injected by the injector.

However, although the injector receives fuel from a fuel distribution pipe and serves to inject the fuel into the intake manifold, it has a problem with its responsiveness with respect to pedal effort of the accelerating pedal, which is retarded since the injector is fixed on both the fuel distribution pipe and the intake manifold.

To solve this problem, it may be possible to fix the injector near the combustion chamber. However, this case does not take into careful consideration an atomization distance of gasoline when determining the position of the injector. If the distance of the atomization distance of the gasoline is short, since gasoline may be introduced into the combustion chamber in a liquid state, combustion efficiency may deteriorate.

However, when the throttle opening is enlarged, thereby increasing the intake amount of air, or when the engine is heated, the short atomization distance of gasoline has no effect on the atomization of gasoline.

SUMMARY OF THE INVENTION

Therefore, the present invention is made in an effort to solve the above described problem.

It is an object of the present invention to provide a fuel injection system which can vary the position of the injector to improve its responsiveness with respect to the variation of the throttle opening when a vehicle quickly increases its speed or is running at high speeds.

To achieve the above object, the present invention provides a fuel injection system having a fuel injector with a variable injection position, comprising:

an accelerating pedal;

a throttle valve for regulating the amount of intake air in response to vehicle speed said throttle valve being connected to said accelerating pedal;

said fuel distribution pipe slidably mounted on an intake manifold;

said injector fixed to said fuel distribution pipe; and means for adjusting the opening of the throttle valve and for varying the position of the injector relative to a combustion chamber in response to pedal effort of the accelerating pedal.

According to a feature of the present invention, the means comprises an accelerating lever which rotates in response to the pedal effort of the accelerating pedal, a rotating member which rotates in accordance with the rotation of the accelerating lever, and a reciprocating member which moves back-and-forth in response to the rotation of the rotating member to vary the position of the fuel distribution pipe that is fixed on the reciprocating member.

According to another feature of the present invention, the rotating member is a pinion that is connected to the accelerating lever through a shaft, and the reciprocating member is a rack that meshes with the pinion, the rack fixed to the fuel distribution pipe which is slidably mounted on the intake manifold by sliding means.

According to still another feature of the present invention, the fuel distribution pipe is fixed between the rack and the sliding means.

According to yet another feature of the invention, the sliding means comprises a sliding leg formed beneath the distribution pipe and a sliding guide member formed on the intake manifold to guide the sliding leg.

According to still another feature of the invention, the fuel injection system further comprises sealing means for sealing up a clearance between the injector and a nozzle seat of the intake manifold.

Preferably, the sealing means is an O-ring inserted in a circumference groove formed on a nozzle seat.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DESCRIPTION OF THE PREFERRED EMBODIMENT

A preferred embodiment of the present invention will now be described in detail with reference to the accompanying drawings.

Figure 1:
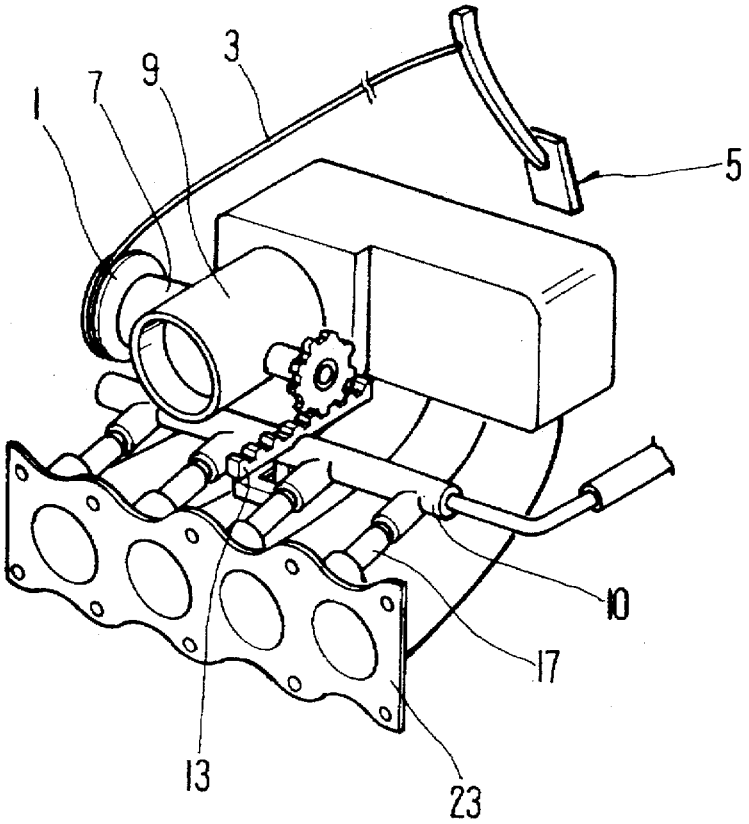
FIG. 1 is a schematic perspective view illustrating a fuel injection system with a variable injection position in accordance with a preferred embodiment of the present invention.

Referring to FIG. 1, the inventive fuel injection system with a variable injection position comprises an accelerating lever 1 that is connected through an accelerating cable 3 to an accelerating pedal 5 and that is rotated in response to the operation of the accelerating pedal 5. The accelerating lever 1 is further connected to a throttle valve 7 through a shaft 9 in order to regulate the throttle valve opening by rotating the throttle valve 9.

The fuel injection system further comprises a pinion 11 that is also connected to the accelerating lever 1 through the shaft 9. In this embodiment, although the throttle valve is located between the accelerating lever 1 and the pinion 11, the structure is not limited to configuration; it is also possible to locate the pinion 11 between the accelerating lever 1 and the throttle valve 9.

Figure 2:
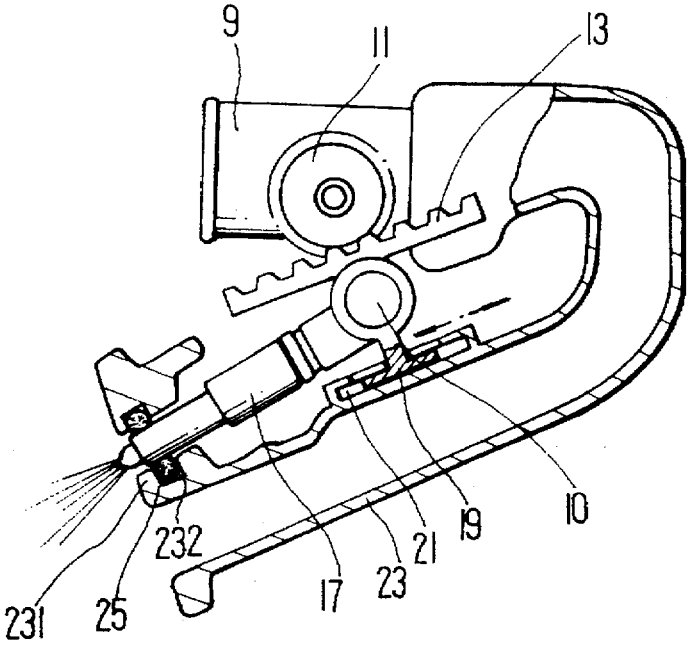
FIG. 2 is a sectional view taken along the line I—I in FIG. 1.

Referring to FIG. 2, the pinion 11 meshes with a rack 13 to move back-and-forth the rack 13 while being rotated by the accelerating lever 1 through the shaft 11. The rack 13 is fixed to the fuel distribution pipe 10.

Though the fuel injection system illustrated in FIG. 1 is one which can be applied to the multi-point injection type, it is not necessary to have plural racks. However, for easy movement of the fuel distribution pipe, it is also possible to provide plural racks and plural pinions that respectively mesh with the plural racks. Thus, the structure of the fuel distribution pipe fixing member can be appropriately modified while considering economic problem and its relative position to other parts around the injector.

On the other hand, to slidably fix the injector 17, there are provided a sliding leg 19 formed on a lower side of the fuel distribution pipe 10 and a sliding guide member 21 formed on an upper side of the intake manifold to guide the sliding motion of the sliding leg 19.

The sliding guide member 21 is designed such that the sliding leg 19 can slide in a direction along the injector 17.

Therefore, when the pinion 11 is rotated by the accelerating lever 1 through the shaft 7, the rack that meshes with the pinion 11 moves back-and-forth so that the fuel distribution pipe 10 and injector 17 can move along the sliding guide member 21 formed on the intake manifold 23.

As the injector varies its position, a sealing problem may occur between a needle seat 231 of the intake manifold 23 and the injector 17. Therefore, in this embodiment, an O-ring 25 is inserted in an inner circumferential groove 232 formed in the needle seat 231 of the intake manifold of the intake manifold 23. As a result, the injector slides while receiving the compression force of the O-ring, thereby enhancing the seal between the injector 17 and the needle seat 231 of the intake manifold 23.

In the fuel injection system as described above, when the pedal effort of the accelerating pedal 5 is increased, this increased pedal effort is transmitted to the accelerating lever 1 through the accelerating cable 3, thereby rotating the accelerating lever 1 and increasing the throttle valve opening.

At this point, the pinion 11, which is connected to both the throttle valve 9 and the accelerating lever 1 through the shaft 7, rotates such that the rack 13 can move towards the combustion chamber (not shown).

As the rack 13 moves towards the combustion chamber, the injector fixedly mounted on the fuel distribution pipe 10 is also displaced towards the combustion chamber.

As a result, as the pedal effort, and consequently, the throttle valve opening are increased, the amount of air fed to the engine is also increased and at the same time, the amount of fuel injected by the injector is increased by the control of an electronic control unit. In addition, as described above, since the injector 17 is displaced towards the combustion chamber, the responsiveness with respect to the pedal effort is improved.

On the other hand, when the pedal effort is decreased to reduce vehicle speed, the accelerating lever 1 that is connected to the pedal 5 rotates in a direction that decreases the throttle opening to reduce the intake of air.

At this point, the pinion also rotates in a direction where the rack 13 can move towards the fuel distribution pipe 10, resulting in displacement of the injector towards its normal position.

While this invention has been described in connection with what is presently considered to be the most practical and preferred embodiments, it is to be understood that the invention is not limited to the disclosed embodiment, but, on the contrary, it is intended to cover various modifications and equivalent arrangements included within the spirit and scope of the appended claims.

What is claimed is:

1. A fuel injection system having a fuel injector with a variable injection position, comprising:

an accelerating pedal;

a throttle valve for regulating the intake of air in response to vehicle speed, said throttle valve being connected to said accelerating pedal;

a fuel distribution pipe;

said injector fluidly connected to said fuel distribution pipe; and means for adjusting the opening of the throttle valve and varying the position of the injector relative to a combustion chamber in response to the pedal effort of the accelerating pedal.

2. A fuel injection system according to claim 1, wherein the means comprises an accelerating lever which rotates in response to the pedal effort of the accelerating pedal, a rotating member which rotates in accordance with the rotation of the accelerating lever, and a reciprocating member which moves back-and-forth in response to the rotation of the rotating member to vary the position of the injector that is fixed on the reciprocating member.

3. A fuel injection system according to claim 2, wherein the rotating member is a pinion that is connected to the accelerating lever through a shaft, and the reciprocating member is a rack that meshes with the pinion, the rack being fixed to said fuel distribution pipe which is slidably mounted by a sliding means.

4. A fuel injection system according to claim 3, wherein the sliding means comprises a sliding leg formed beneath the fuel distribution pipe and a sliding guide member formed on an intake manifold to slidably guide the sliding leg.

5. A fuel injection system according to claim 1 further comprising sealing means for sealing up a clearance between the injector and a nozzle seat of the intake manifold.

6. A fuel injection system according to claim 1, wherein the sealing means is an O-ring inserted in a circumference groove formed on a nozzle seat.

7. A fuel injection system having a fuel injector with a variable injection position, comprising:

an accelerating pedal;

a throttle valve for regulating the intake of air in response to vehicle speed, said throttle valve being connected to said accelerating pedal;

a fuel distribution pipe;

said injector fluidly connected to said fuel distribution pipe;

an accelerating lever connected to said accelerating pedal; and a reciprocating member which moves in accordance with the movement of the accelerating pedal and is attached to said injector.

8. The fuel injection system according to claim 7, further comprising a pinion that is connected to said accelerating lever through a shaft and wherein the reciprocating member is a rack that meshes with said pinion, said rack being fixed to said fuel distribution pipe and is slidably mounted to a sliding assembly.

9. The fuel injection system according to claim 8, wherein the sliding assembly comprises a sliding leg formed beneath said fuel distribution pipe and a sliding guide member formed on an intake manifold to slidably guide the sliding leg.

10. The fuel injection system according to claim 7, further comprising an o-ring inserted in a circumference groove formed on a nozzle seat.

* * * * *